US010573220B2

(12) United States Patent
Xiang et al.

(10) Patent No.: US 10,573,220 B2
(45) Date of Patent: Feb. 25, 2020

(54) DISPLAY PANEL AND ELECTRONIC DEVICE FOR DISPLAYING IN DIFFERENT DISPLAY MODES

(71) Applicant: SHANGHAI TIANMA AM-OLED CO., LTD., Shanghai (CN)

(72) Inventors: Dongxu Xiang, Shanghai (CN); Yue Li, Shanghai (CN); Zeyuan Chen, Shanghai (CN); Yana Gao, Shanghai (CN); Renyuan Zhu, Shanghai (CN); Zhonglan Cai, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 102 days.

(21) Appl. No.: 15/862,601

(22) Filed: Jan. 4, 2018

(65) Prior Publication Data

US 2018/0130401 A1 May 10, 2018

(30) Foreign Application Priority Data

Aug. 17, 2017 (CN) ..... 2017 1 0707983

(51) Int. Cl.

| | |
|---|---|
| ***G09G 3/20*** | (2006.01) |
| ***G09G 3/34*** | (2006.01) |
| ***G09G 5/02*** | (2006.01) |

(52) U.S. Cl.

CPC ..... *G09G 3/2074* (2013.01); *G09G 3/2003* (2013.01); *G09G 3/3406* (2013.01); (Continued)

(58) Field of Classification Search

CPC .... G09G 3/2003; G09G 3/364; G09G 3/2074; G09G 2300/0443; G09G 2340/0407

See application file for complete search history.

(56) References Cited

U.S. PATENT DOCUMENTS

2013/0027437 A1* 1/2013 Gu ..... G09G 3/3607 345/690
2014/0104298 A1* 4/2014 Park ..... G09G 5/10 345/589

(Continued)

FOREIGN PATENT DOCUMENTS

CN 102903318 A 1/2013
CN 103730098 A 4/2014

(Continued)

*Primary Examiner* — Xuemei Zheng

(74) *Attorney, Agent, or Firm* — Kilpatrick Townsend & Stockton, LLP

(57) ABSTRACT

Disclosed are a display panel and an electronic device. The display panel includes sub-pixels arranged in an array, wherein each pixel row of the sub-pixels comprises 3n sub-pixels, with every six adjacent sub-pixels of the pixel row forming a pixel group, n≥2, and the six adjacent sub-pixels of the pixel group are arranged in sequential order in a first direction parallel to the row direction. The display panel further includes a controller, where in a first display mode the controller controls each of the sub-pixels to be charged to emit light; and in a second display mode the controller controls at most two sub-pixels of each of the pixel groups in at least one of the pixel rows to not emit light, and controls at most two sub-pixels of the pixel group which have same order in two adjacent frames of pictures to not emit light.

20 Claims, 20 Drawing Sheets

(52) U.S. Cl.
CPC ..... *G09G 5/02* (2013.01); *G09G 2300/0443* (2013.01); *G09G 2300/0452* (2013.01); *G09G 2340/0457* (2013.01)

(56) References Cited

U.S. PATENT DOCUMENTS

| | | | | |
|---|---|---|---|---|
| 2015/0097764 | A1 | 4/2015 | Pyo et al. | |
| 2016/0240146 | A1* | 8/2016 | Lee | G09G 3/3291 |
| 2017/0132990 | A1* | 5/2017 | He | G09G 5/227 |

FOREIGN PATENT DOCUMENTS

| | | | |
|---|---|---|---|
| CN | 104751821 | A | 7/2015 |
| CN | 104851400 | A | 8/2015 |
| CN | 104933983 | A | 9/2015 |
| CN | 105895019 | A | 8/2016 |

* cited by examiner

DISPLAY PANEL AND ELECTRONIC DEVICE FOR DISPLAYING IN DIFFERENT DISPLAY MODES

CROSS-REFERENCE TO RELATED APPLICATIONS

This application claims priority to Chinese Patent Application No. 201710707983.6, filed on Aug. 17, 2017 and entitled "DISPLAY PANEL AND ELECTRONIC DEVICE", the disclosure of which is incorporated herein by reference in its entirety.

TECHNICAL FIELD

The present disclosure relates to display technologies, and in particular, to a display panel and an electronic device.

BACKGROUND

With the rapid development of portable electronic terminal devices especially mobile phones and tablet PCs, the electronic terminal devices have more and more functions. The use for functions such as movie watching, video calls and mobile games requires the electronic terminal devices to have excellent visual effects. As a result, the resolution of today's electronic terminal devices is getting higher and higher.

With the global demand for low-carbon life, more and more people also focus on the the low power consumption and the long battery life for the electronic terminal devices. It is known that each component of the electronic terminal device may have the low power consumption in order to ensure the low power consumption in total. For the electronic terminal devices such as mobile phones, tablet PCs, it is also meaningful to reduce the power consumption of the displayed picture thereof.

However, the high resolution of the displayed picture of the electronic terminal device will lead to increase in the power consumption of the electronic terminal device.

SUMMARY

The present disclosure provides a display panel and an electronic device in order to reduce the power consumption of the display panel.

In a first aspect, embodiments of the disclosure provide a display panel, which comprises: a plurality of sub-pixels arranged in an array, and each pixel row of the sub-pixels comprises 3n sub-pixels, with every six adjacent sub-pixels of the pixel row forming a pixel group, and n≥2, and the six adjacent sub-pixels of the pixel group are arranged in a sequential order in a first direction, and the first direction is parallel to the row direction. The display panel further includes a controller, a first display mode, the controller controls each of the sub-pixels to be charged to emit light; and in a second display mode, the controller controls at most two sub-pixels of each of the pixel groups in at least one of the pixel rows to not emit light, and the controller controls at most two sub-pixels of the pixel group which have same order in two adjacent frames of pictures to not emit light.

In a second aspect, embodiments of the disclosure further provide an electronic device, which comprises the display panel according to any of the embodiments of the disclosure.

In the embodiments of the present disclosure, the display panel includes controller to perform a control function in the first display mode and the second display mode and is capable of switching between the first display mode and the second display mode. When the display panel displays a picture by using the first display mode, the controller controls each of the sub-pixels to emit light to enable the display panel to display each frame of picture, thereby obtaining a high-quality and high-resolution picture; when the display panel displays the picture using the second display mode, the controller controls a part of the sub-pixels to turn off to enable the display panel to display each frame of the picture by instead using other sub-pixels, thereby reducing the power consumption so as to improve the battery life of the electronic device integrated with the display panel. In addition, when the display panel display a picture by using the second display mode, the controller controls the sub-pixels of the pixel group which have different orders in two adjacent frames of pictures to not emit light, thereby preventing black spots, vertical stripes, horizontal stripes, and other defects from being observed by the human eye, and hence ensuring the display effect of the display panel while reducing the power consumption.

BRIEF DESCRIPTION OF THE DRAWINGS

Drawings needed in the embodiments of the disclosure will be introduced briefly below for more clearly illustrating the technical solutions of the exemplary embodiments of the disclosure. It will be apparent that, the drawings merely illustrate exemplary embodiments of the disclosure. Those skilled in the art can conceive other drawings from the illustrated drawings without inventive efforts.

DETAILED DESCRIPTION

The application will be illustrated in detail in conjunction with the drawings and embodiments. It may be understood that, the embodiments described here are only a part of embodiments of the disclosure, rather than all of the embodiments. All other embodiments obtained by those of ordinary skill in the art based on embodiments of the disclosure without making creative work should fall within the scope of the disclosure.

Figure 1:
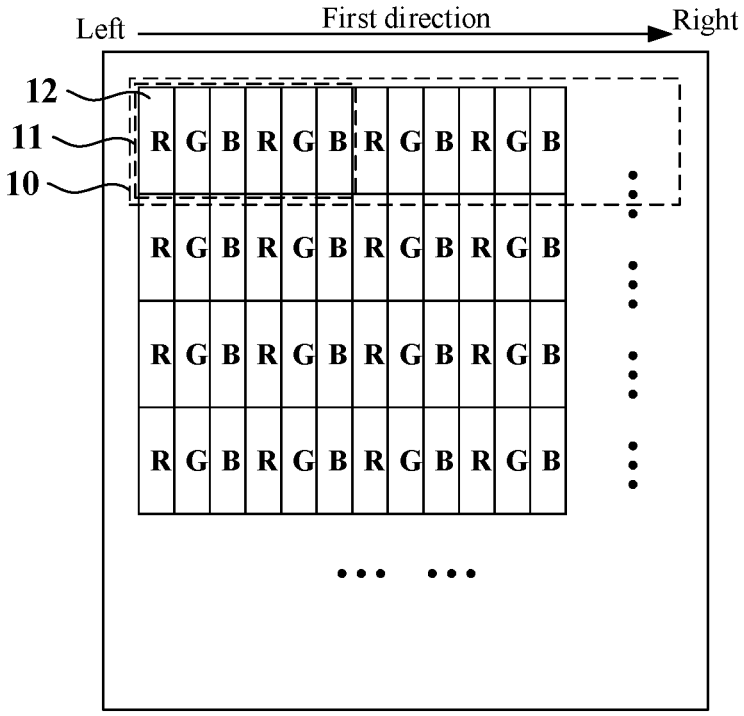
FIG. 1 is a schematic view of a display panel according to an embodiment of the disclosure.

FIG. 1 is a schematic view of a display panel according to an embodiment of the disclosure. Referring to FIG. 1, the display panel provided by the present embodiment includes a plurality of sub-pixels 12 arranged in an array, and each pixel row 10 of the sub-pixels 12 includes 3n sub-pixels 12, with every six adjacent sub-pixels 12 of the pixel row 10 forming a pixel group 11, and n≥2, and the six adjacent sub-pixels 12 of the pixel group 11 are arranged in a sequential order in a first direction, and the first direction is parallel to the row direction. The display panel also includes a controller, wherein in a first display mode the controller controls to each of the sub-pixels 12 to be charged to emit light; and in a second display mode, the controller controls at most two sub-pixels 12 of each of the pixel groups 11 in at least one of the pixel rows 10 to not emit light, and the controller controls at most sub-pixels 12 of the pixel group 11 which have same order in two adjacent frames of pictures to not emit light.

The display panel provided by the present embodiment includes the controller to make control function in two display modes, that is, a first display mode and a second display mode.

With the display panel of the present embodiment, when the first display mode is used to display a picture, the controller controls each sub-pixel 12 to be charged in each frame of displayed picture to emit light, that is, the first display mode is a full sub-pixel light emission mode. When the first display mode is used to display a picture, the controller controls each sub-pixel 12 to emit light to display each frame of picture, so that a high quality and high resolution of the picture may be obtained.

Figure 2A:
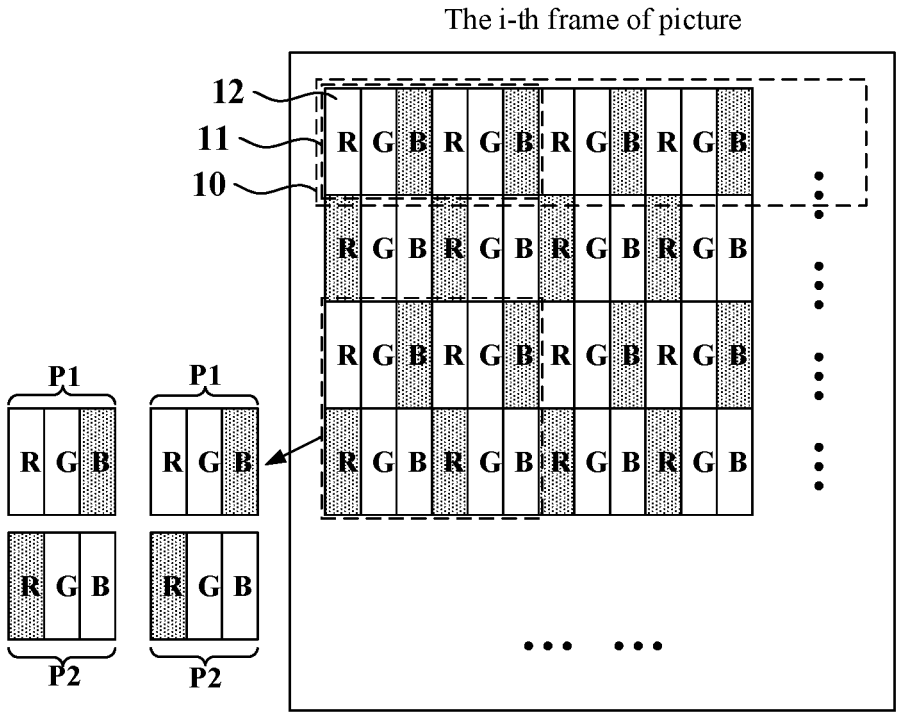
FIGS. 2A to 2B are schematic views of a second display mode of the display panel shown in FIG. 1, FIGS. 3A to 3B are schematic views of a second display mode of the display panel shown in FIG. 1, FIGS. 4A to 4B are schematic views of a second display mode of the display panel shown in FIG. 1.
Figure 2B:
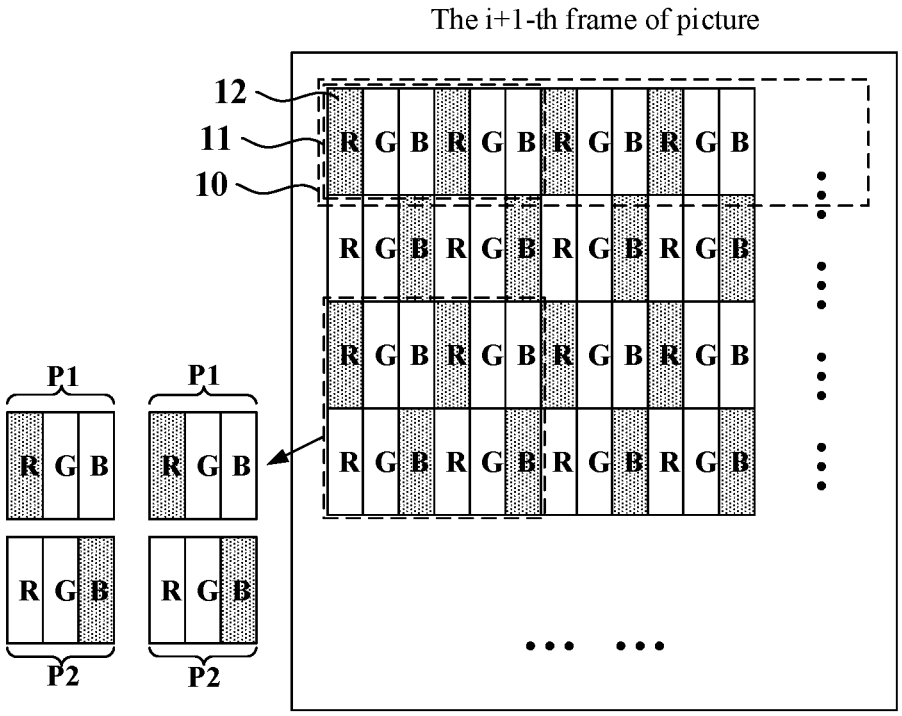

FIGS. 2A and 2B are schematic views of a second display mode of the display panel according to an embodiment of the disclosure, and in the second display mode, the controller controls at most two sub-pixels 12 of each pixel group 11 of at least one pixel row 10 in each frame of picture not emit light, that is, the second display mode is a partial sub-pixel light emission mode. When the second display mode is used to display a picture, the controller controls a part of the sub-pixels 12 to turn off and display each frame of picture in a manner that other sub-pixel 12 is instead used, thereby reducing the power consumption so as to improve the battery life of the electronic device integrated with the display panel. In the drawings, the sub-pixel filled with shadows is used to indicate a sub-pixel which does not emit light.

A pixel group 11 in the display panel includes six adjacent sub-pixels 12. Optionally in the present embodiment, the first direction is a direction which points from the left side of the display panel to the right side thereof. The first direction is parallel to the row direction of the display panel. The corresponding pixel group 11 includes six sub-pixels 12 sequentially adjacent to each other in the first direction and the six sub-pixels 12 are arranged in sequential order of the first sub-pixel to the sixth sub-pixel in the first direction. In the following embodiments, the sub-pixels of the pixel group 11 are also arranged in a sequential order in the first direction from the left side of the display panel to the right side thereof. It will be appreciated by those skilled in the art that optionally in other embodiments of the disclosure, the first direction may also be the direction from the right side of the display panel to the left side thereof.

It should be noted that when the second display mode is used to display a picture, the display panel control at most two sub-pixels 12 of a pixel group 11 to not emit light. If more than two sub-pixels 12 in a pixel group 11 do not emit light, the resolution of the displayed picture may be too low. However, it is also possible to control at most three sub-pixels 12 in a pixel group 11 to not emit light when the display panel uses the second display mode to display a picture in a special case where the battery of the electronic device is too low. On the other hand, when the second display mode is used to display a picture, the controller controls a part of the sub-pixels 12 in at least one pixel row 10 to not emit light, thereby reducing the number of sub-pixels 12 which emit light in a frame of picture, and hence reducing the power consumption.

It should be noted that when the display panel uses the second display mode to display a picture, the controller controls the sub-pixels 12 of same pixel group 11 which have different orders in two adjacent frames of pictures to not emit light. If a sub-pixel 12 does not emit light in both the two adjacent frames of pictures, black spots could be observed by the human eye. If a column of sub-pixels 12 does not emit light in both the two adjacent frames of pictures, vertical stripes could be observed by the human eye. Also, if a row of sub-pixels 12 does not emit light in both the two adjacent frames of pictures, horizontal stripes could be observed by the human eye, and so on. On this basis, when the display panel uses the second display mode to display a picture, the controller controls the sub-pixels 12 of the pixel group 11 which have different orders in two adjacent frames of pictures to not emit light, thereby preventing black spots, vertical stripes, horizontal stripes, and other defects from being observed by the human eye, and hence ensuring the display effect of the display panel while reducing the power consumption.

As shown in FIG. 1, the sub-pixels of the pixel group 11 in each of the pixel rows 10 are arranged in the order of colors R, G, B, R, G, B. The display panel provided by the present embodiment may be provided as a real RGB display panel, i.e., the sub-pixels 12 of each pixel row 10 are arranged in the order of colors R, G, B, R, B, and each three adjacent RGBs forms a pixel unit, and the pixel group 11 includes such two of the pixel units. It should be noted that, in the present disclosure, R, G, and B are abbreviations of Red, Green and Blue, respectively.

The Real RGB display panel can provide a high-resolution, high-quality and delicate displayed picture when the first display mode is used to display a picture. However, because a white pixel is associated with three sub-pixels RGB 12 in the real RGB display panel, the Real RGB display panel has the high power consumption during displaying. In this case, the real RGB display panel can use the second display mode to display a picture when the battery level thereof is insufficient, thereby reducing the power consumption and prolonging the use time of the electronic device. According to the different requirements, the display panel can switch the display mode for example, to the first display mode when the video is being viewed, or the second display mode when the battery level is low.

It will be understood by those skilled in the art that the display panel may adjust the display mode in accordance with the battery level of the electronic device or the requirement of the user on displaying. The display mode of the display panel of the present disclosure may be adjusted automatically or passively, which is specifically limited. After the display mode of the display panel is adjusted, the display panel displays the picture in accordance with the adjusted display mode.

In the present embodiment, the display panel includes the first display mode and the second display mode and is capable of switching between the first display mode and the second display mode. When the display panel displays a picture by using the first display mode, the controller controls each of the sub-pixels to emit light to display each frame of picture, thereby obtaining a high-quality and high-resolution picture; when the display panel displays the picture by using the second display mode, the controller controls a part of the sub-pixels to turn off and can display each frame of the picture by instead using other sub-pixels, thereby reducing the power consumption so as to improve the battery life of the electronic device integrated with the display panel. In addition, when the display panel display a picture by using the second display mode, the controller controls the sub-pixels of the pixel group which have different orders in two adjacent frames of pictures to not emit light, thereby preventing black spots, vertical stripes, horizontal stripes, and other defects from being observed by the human eye, and hence ensuring the display effect of the display panel while reducing the power consumption.

On the basis of the technical scheme shown in FIG. 1, the second display mode is optionally provided as shown in FIGS. 2A and 2B. The controller controls two sub-pixels 12 of each of the pixel groups 11 in the odd-numbered pixel rows 10 to not emit light, and the controller controls two sub-pixels 12 of each of the pixel groups 11 in the even-numbered pixel rows 10 to not emit light, and for a frame of picture, the two sub-pixels 12 of a pixel group 11 in a column which do not emit light have different orders from the two sub-pixels 12 of the adjacent pixel group 11 in the column which do not emit light; and for two adjacent frames of pictures, the two sub-pixels 12 of a pixel group 11 in the frame which do not emit light have different orders from the two sub-pixels 12 of the pixel group 11 in the next frame which do not emit light. For example, in the i-th frame of picture, the third and sixth sub-pixels 12 of each of the pixel groups 11 in the odd-numbered pixel rows 10 do not emit light, and the first and four sub-pixels 12 of each of the pixel groups 11 in the even-numbered pixel rows 10 do not emit light. In the i+1-th frame of picture, the first and fourth sub-pixels 12 of each of the pixel groups 11 in the odd-numbered pixel rows 10 do not emit light, and the third and sixth sub-pixels 12 of each of the pixel groups 11 in the even-numbered pixel rows 10 do not emit light.

In practical applications, the controller controls the data lines corresponding to the sub-pixel which does not emit light to not output the data voltage signal, so that the display panel can control the corresponding sub-pixel to not emit light. As shown in FIG. 2A, the controller controls the sub-pixel B of the odd-numbered pixel row to not emit light and controls the sub-pixel R of even-numbered pixel row to not emit light. At this time, the sub-pixels RG of each pixel unit P1 in the odd-numbered pixel row form a pixel unit and can achieve the normal display by instead using the neighboring sub-pixel. Similarly, the sub-pixels GB of each pixel unit P2 in the even-numbered pixel row form a pixel unit and can achieve the normal display by instead using the neighboring sub-pixel. In FIG. 2B, in an embodiment, the controller controls the sub-pixel R of the odd-numbered pixel row to not emit light and controls the sub-pixel B of the even-numbered pixel row to not emit light. At this time, the sub-pixels GB of each pixel unit P1 in the odd-numbered pixel row form a pixel unit and can achieve the normal display by instead using the neighboring sub-pixel, the sub-pixels RG of each pixel unit P2 in the even-numbered pixel row form a pixel and can achieve the normal display by instead using the neighboring sub-pixel. This prevents the darkened sub-pixel from being observed by the human eye.

When the display panel provided in FIGS. 2A and 2B uses the second display mode to display a picture, the controller controls two sub-pixels 12 of each pixel group 11 to not emit light. Compared with the first display mode, at least ⅓ of the power consumption of the display panel can be reduced. When the display panel displays a frame of picture, the sub-pixels 12 having different orders in the pixel group 11 of the odd-numbered pixel row and the sub-pixel 12 of the even-numbered pixel row do not emit light, thereby preventing the darkened sub-pixel (i.e., the sub-pixel which does not emit light) from being observed by the human eye. Also, for two adjacent frames of pictures, the two sub-pixels 12 of a pixel group 11 in the frame which do not emit light have different orders from the two sub-pixels 12 of the pixel group 11 in the next frame which do not emit light, thereby also preventing the darkened sub-pixel from being observed by the human eye, so that the display effect of the display panel can be ensured.

Figure 3A:
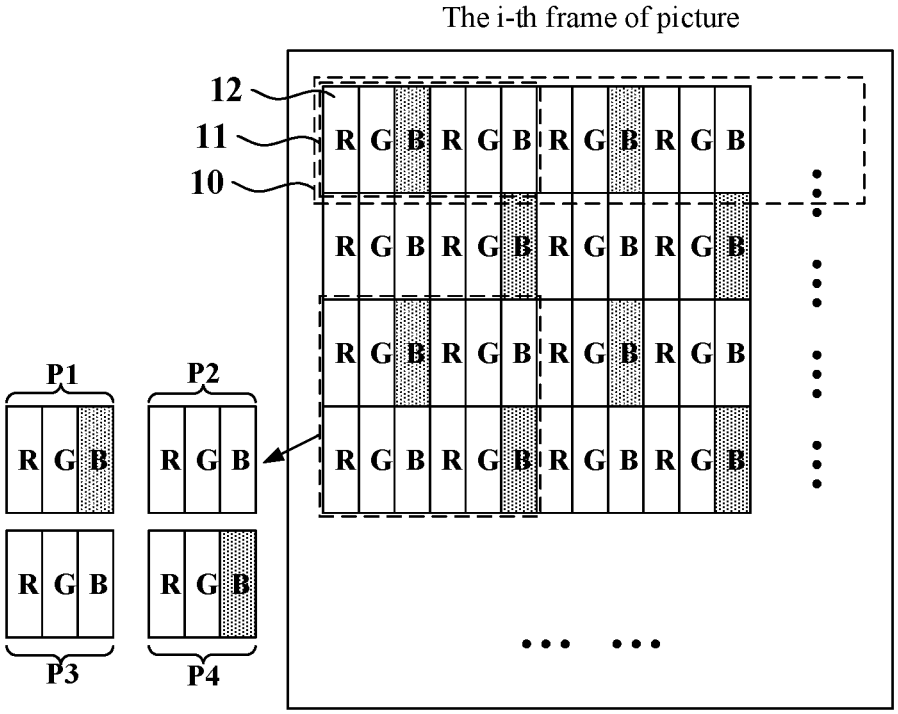
Figure 3B:
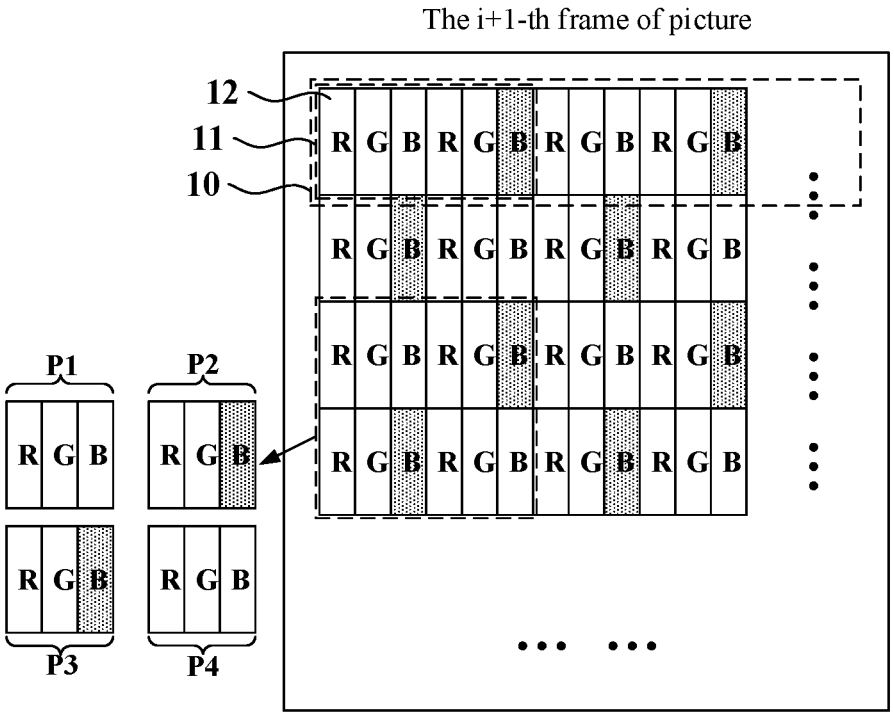

On the basis of the technical solution shown in FIG. 1, the second display mode may be provided as shown in FIGS. 3A and 3B. The controller controls one sub-pixel 12 of each of the pixel groups 11 in the odd-numbered pixel rows 10 to not emit light, and the controller controls one sub-pixel 12 of each of the pixel groups 11 in the even-numbered pixel rows 10 to not emit light, and for a frame of picture, the sub-pixel 12 of a pixel group 11 in a column which does not emit light has a different order from the sub-pixel 12 of the adjacent pixel group 11 in the column which does not emit light; and for two adjacent frames of pictures, the sub-pixel 12 of a pixel group 11 in the frame which does not emit light has a different order from the sub-pixel 12 of the pixel group 11 in the next frame which does not emit light. For example, in the i-th frame of picture, the third sub-pixel 12 of each of the pixel groups 11 in the odd-numbered pixel row 10 does not emit light, and the sixth sub-pixel 12 of each of the pixel groups 11 in the even-numbered pixel row 10 does not emit light. In the i+1-th frame of picture, the sixth sub-pixel 12 of each of the pixel groups 11 in the odd-numbered pixel row 10 does not emit light, and the third sub-pixels 12 of each of the pixel groups 11 in the even-numbered pixel row 10 does not emit light.

As shown in FIG. 3A, the controller controls the third sub-pixel of each pixel group in the odd-numbered pixel row to not emit light and controls the sixth sub-pixel of each pixel group in the even-numbered pixel row to not emit light. At this time, the sub-pixels RG of the pixel unit P1 form a pixel unit and can achieve the normal display by instead using the neighboring sub-pixel. The sub-pixels RGB of the pixel unit P2 form a pixel unit, the sub-pixels RGB of the pixel unit P3 form a pixel unit, and the sub-pixels RG of the pixel unit P4 form a pixel unit and can achieve the normal display by instead using the neighboring sub-pixel. As shown in FIG. 3B, the controller controls the sixth sub-pixel of each pixel group in the odd-numbered pixel row to not emit light and controls the third sub-pixel of each pixel group in the even-numbered pixel row to not emit light. At this time, the sub-pixels RGB of the pixel unit P1 form a pixel unit, the sub-pixels RG of the pixel unit P2 form a pixel unit and can achieve the normal display by instead using the neighboring sub-pixel, the sub-pixels RG of the pixel unit P3 form a pixel unit and can achieve the normal display by instead using the neighboring sub-pixel, and the sub-pixels RGB of the pixel unit P4 form a pixel unit. This prevents the dark sub-pixel from being observed by the human eye.

In the display panel provided in FIGS. 3A and 3B, the power consumption of the display panel can be reduced, and also it is possible to prevent the dark sub-pixel (i.e., the sub-pixel which does not emit light) from being observed by the human eye, so that the display effect of the display panel can be ensured.

Figure 4A:
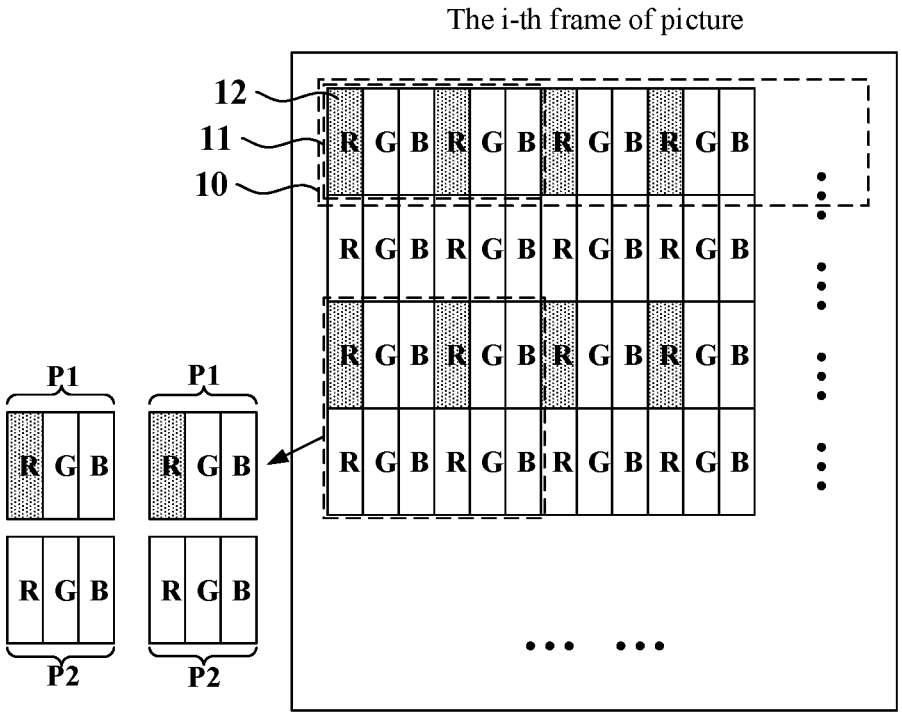
Figure 4B:
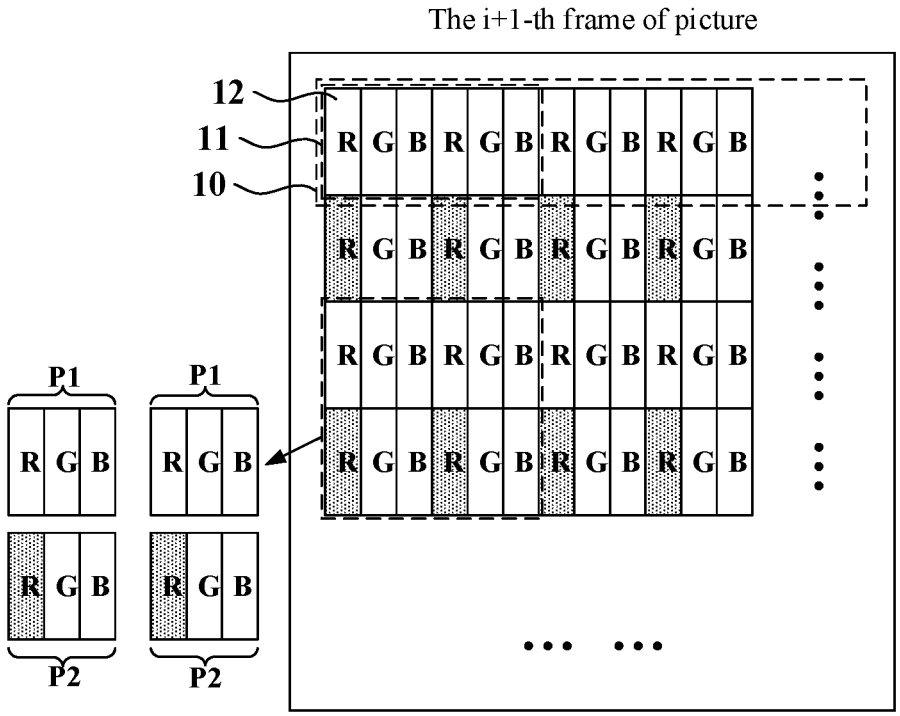

On the basis of the technical solution shown in FIG. 1, the second display mode may be provided as shown in FIGS. 4A and 4B. In the i-th frame of picture, the controller controls two sub-pixels 12 of each of the pixel groups 11 in the odd-numbered pixel rows 10 to not emit light, and in the i-th frame of picture, the controller controls two sub-pixels 12 of each of the pixel groups 11 in the even-numbered pixel rows 10 to not emit light. For example, in the i-th frame of picture, the first and fourth sub-pixels 12 of each of the pixel groups 11 in the odd-numbered pixel row 10 to not emit light, and in the i-th frame of picture, the first and fourth sub-pixels 12 of each of the pixel groups 11 in the even-numbered pixel row 10 to not emit light.

As shown in FIG. 4A, the controller controls the first and fourth sub-pixels of each of the pixel groups in the odd-numbered pixel rows to not emit light. At this time, the sub-pixels GB of the pixel unit P1 of each of the pixel groups 11 in the odd-numbered pixel rows form a pixel unit and can achieve the normal display by instead using the neighboring sub-pixel, and the sub-pixels RGB of the pixel unit P2 of each of the pixel groups 11 in the even-numbered pixel rows form a pixel unit. As shown in FIG. 4B, the controller controls the first and fourth sub-pixels of each of the pixel groups in the even-numbered pixel rows to not emit light. At this time, the sub-pixels RGB of the pixel unit P1 of each of the pixel groups 11 in the odd-numbered pixel rows form a pixel unit, and the sub-pixels GB of the pixel unit P2 of each of the pixel groups 11 in the even-numbered pixel rows form a pixel unit form a pixel unit and can achieve the normal display by instead using the neighboring sub-pixel.

In the display panel provided in FIGS. 4A and 4B, the power consumption can be reduced, and it is also possible to prevent defects such as black spots from being observed by the human eye, thereby ensuring the display effect of the display panel. In other embodiments, the two sub-pixels of each of the pixel groups in the odd-numbered pixel rows which do not emit light have different orders from the two sub-pixels of each of the pixel groups in the even-numbered pixel rows which do not emit light.

Figure 5:
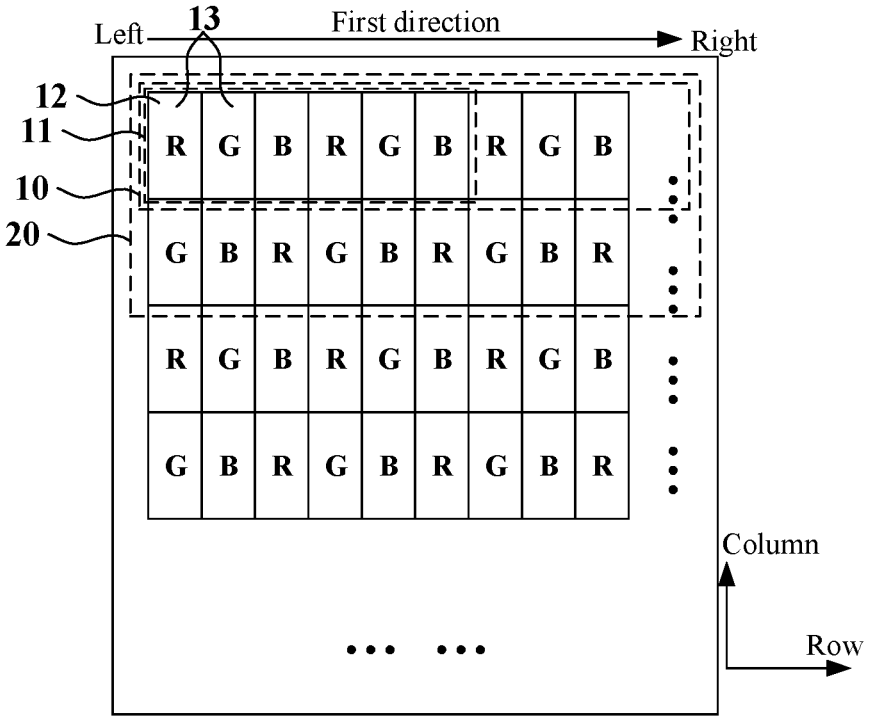
FIG. 5 is a schematic view of another display panel according to an embodiment of the disclosure.

FIG. 5 is a schematic view of another display panel according to an embodiment of the present disclosure. Referring to FIG. 5, the display panel provided by the present embodiment includes a plurality of sub-pixels 12 arranged in an array, and each pixel row 10 of the sub-pixels 12 includes 3n sub-pixels 12, with every six adjacent sub-pixels 12 of the pixel row 10 forming a pixel group 11, and n≥2, and the six adjacent sub-pixels 12 of the pixel group 11 are arranged in a sequential order in a first direction, and the first direction is parallel to the row direction; a first display mode in which the controller controls to each of the sub-pixels 12 to be charged to emit light; and a second display mode in which the controller controls at most two sub-pixels 12 of each of the pixel groups 11 in at least one of the pixel rows 10 to not emit light, and the controller controls the sub-pixels 12 of the pixel group 11 which have different orders in two adjacent frames of pictures to not emit light.

The plurality of sub-pixels 12 form a plurality of sub-pixel regions 20 arranged in a sequential order in a column direction, each of the pixel regions 20 includes a first pixel row to an m-th pixel row, and m≥2; in each of the pixel regions 20, every two adjacent sub-pixels 12 in the i-th pixel row form a pixel unit 13, every three pixel unit 13 form a pixel group 11, and the pixel groups 11 are arranged in the i-th color order, and two adjacent sub-pixels 12 have different colors, respectively, and i=1,2, . . . , m.

It should be noted that a pixel group 11 in the display panel includes six adjacent sub-pixels 12. In the present embodiment, the first direction is a direction which points from the left side of the display panel to the right side thereof, and the first direction is parallel to the row direction of the display panel. The corresponding pixel group 11 includes six sub-pixels 12 sequentially adjacent to each other in the first direction and the six sub-pixels 12 are arranged in sequential order of the first sub-pixel to the sixth sub-pixel in the first direction. In the following embodiments, the sub-pixels of the pixel group 11 are also arranged in a sequential order in the first direction from the left side of the display panel to the right side thereof. It will be appreciated by those skilled in the art that optionally in other embodiments of the disclosure, the first direction may also be the direction from the right side of the display panel to the left side thereof.

In the present embodiment, each pixel unit 13 (i.e, the main pixel in the display panel) is formed of every two adjacent sub-pixels 12 in a row. For example, one of the pixel units 13 is RG one of the pixel units 13 is GB, and one of the pixel units 13 is BR. Each pixel group 11 is formed of three adjacent pixel units 13 in a row. For example, one of the pixel groups 11 may be arranged in a sequential order of RG, BR, and GB periodically, or one of the pixel groups 11 may be arranged a sequential order of GB, RG and BR periodically, or one of sub-pixel groups 11 may be arranged a sequential order of BR, GB and RG periodically. In the present embodiment, each of the pixel regions 20 includes m pixel rows 10, with each pixel row 10 corresponding to a color order. Any two adjacent sub-pixels 12 of the sub-pixels have different colors, respectively, and i=1, 2, . . . , m. Therefore, any two adjacent pixel rows 10 of the pixel rows in the pixel region 20 have different color orders, respectively. In one embodiment, the length of each sub-pixel 12 in the column direction is two times the length of the sub-pixel 12 in the row direction. In one embodiment, the two sub-pixels 12 of each pixel unit 13 form a square pixel zone.

Based on this, the display panel provided by the present embodiment may perform a pixel arrangement using a Sub Pixel Rendering (SPR), which reduces the number of channels of the driver IC in the display panel, thereby improving the product penetration and reducing the power consumption.

In the present embodiment, the display panel includes the first display mode and the second display mode, and is capable of switching between the first display mode and the second display mode.

When the display panel displays a picture by using the first display mode, the controller controls each of the sub-pixels 12 to emit light to display each frame of picture, thereby obtaining a high-quality and high-resolution picture.

When the display panel displays the picture using the second display mode, the controller controls a part of the sub-pixels 12 to turn off and can display each frame of the picture by instead using other sub-pixel 12, thereby reducing the power consumption so as to improve the battery life of the electronic device integrated with the display panel. In addition, when the display panel display a picture by using the second display mode, the controller controls the sub-pixels 12 of the pixel group 11 which have different orders in two adjacent frames of pictures to not emit light, thereby preventing black spots, vertical stripes, horizontal stripes, and other defects from being observed by the human eye, and hence ensuring the display effect of the display panel while reducing the power consumption.

In one embodiment, m≤3, and then the pixel groups of the first pixel row are arranged in the first color order of R, G, B, R, G and B, the pixel groups of the second pixel row are arranged in the second color order of G, B, R, G, B and R, and the pixel groups of the third pixel row are arranged in the third color order of B, R, G, B, R and G As shown in FIG. 5, m=2, and then the pixel groups of the first pixel row are arranged in the first color order of R, G, B, R, G, and B, the pixel groups of the second pixel row are arranged in the second color order of G, B, R, G, B, and R. In other embodiments, m=3, and then the pixel groups of the first pixel row are arranged in the first color order of R, G, B, R, G, and B, and the pixel groups of the second pixel row are arranged in the second color order of G, B, R, G, B, and R, and the pixel groups of the third pixel row are arranged in the third color order of B, R, G, B, R, and G It will be understood by those skilled in the art that on the basis of the different colors of two adjacent sub-pixels, the arrangement of the color order of the display panel is not limited to what shown in FIG. 5, and the arrangement can be designed by those skilled in the art.

Figure 6A:
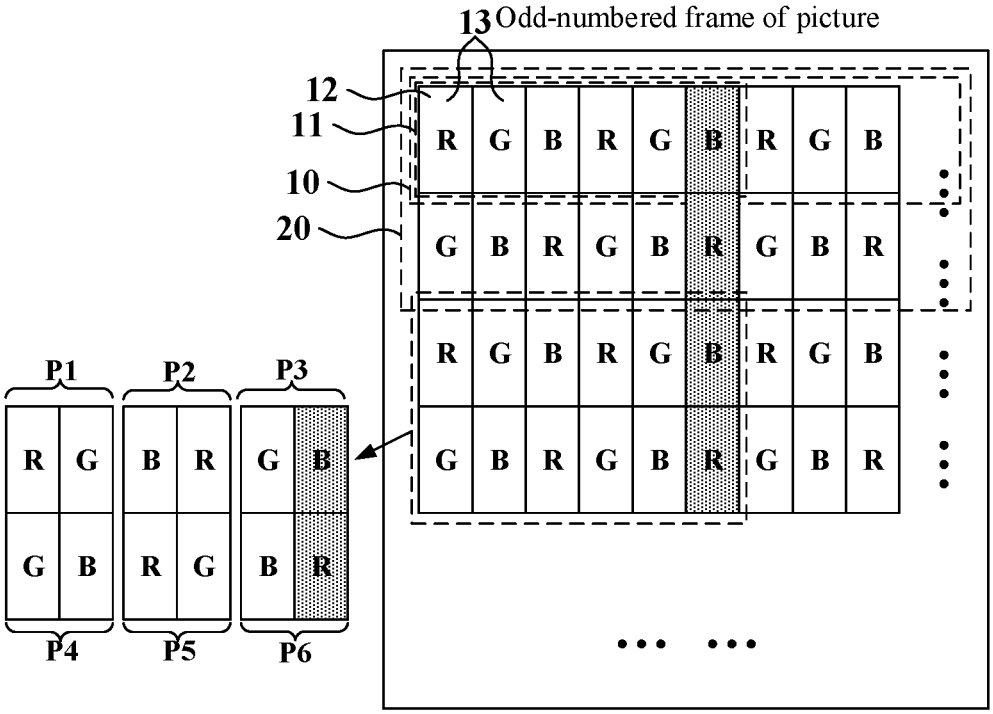
FIGS. 6A to 6B are schematic views of a second display mode of the display panel shown in FIG. 5, FIGS. 7A to 7B are schematic views of a second display mode of the display panel shown in FIG. 5, FIGS. 8A to 8B are schematic views of a second display mode of the display panel shown in FIG. 5, FIGS. 9A to 9C are schematic views of a second display mode of the display panel shown in FIG. 5, FIGS. 10A to 10B are schematic views of a second display mode of the display panel shown in FIG. 5.
Figure 6B:
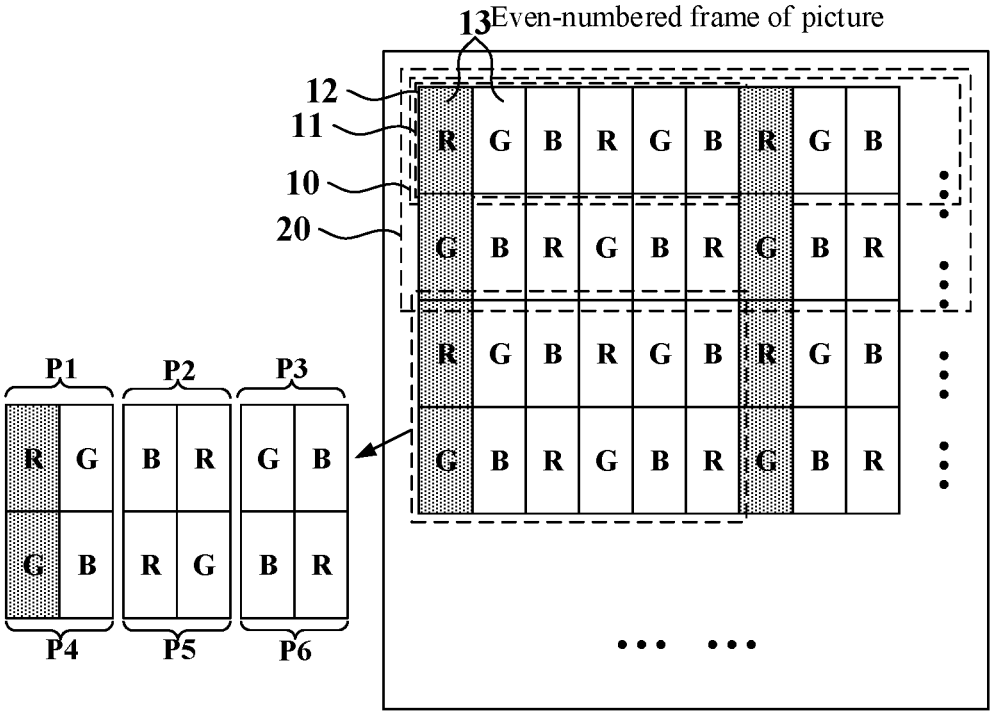

On the basis of the technical solution shown in FIG. 5, the second display mode may be provided as shown in FIGS. 6A and 6B. Specifically, in the odd-numbered frames of pictures, the controller controls the q-th sub-pixel 12 of each of the pixel groups 11 to not emit light, and in the even-numbered frames of pictures, the controller controls the p-th sub-pixel 12 of each of the pixel groups 11 to not emit light, and q=1 and p=6, or, q=6 and p=1. For example, q=6 and p=1, as shown in FIG. 6A, in the second display mode, in the odd-numbered frames of pictures, the controller controls the sixth sub-pixel 12 of each of the pixel groups 11 to not emit light; and as shown in FIG. 6B, in the even-numbered frames of pictures, the controller controls the first sub-pixel 12 of each of the pixel groups 11 to not emit light. In other embodiments, it is also possible that q=1 and p=6.

In one embodiment, for any of the pixel groups 11, when the sixth sub-pixel 12 of the pixel group 11 does not emit light, the first pixel unit of the pixel group 11 instead uses the third sub-pixel 12 thereof to form a light-emitting bright spot, and the second pixel unit of the pixel group 11 instead uses the fifth sub-pixel 12 thereof to form a light-emitting bright spot. Here, a light-emitting bright spot is a pixel including R, G, and B. As shown in FIG. 6A, the sub-pixel B of the pixel unit P3 is darken (i.e., does not emit light), and the sub-pixel R of the pixel unit P6 is darken. At this time, the pixel units P1, P2, and P3 form two pixels, that is, the pixel unit P1 instead uses the sub-pixel B of the pixel unit P2 to form a pixel RGB, and the pixel unit P2 instead uses the sub-pixel G of the pixel unit P3 to form a pixel BRG The pixel units P4, P5 and P6 form two pixels, that is, the pixel unit P4 instead uses the sub-pixel R of the pixel unit P5 to form a pixel GBR, and the pixel unit P5 instead uses the sub-pixel B of the pixel unit P6 to form a pixel RGB, and so on. Each of the pixel groups forms two pixels.

In one embodiment, for any of the pixel groups 11, when the first sub-pixel 12 of the pixel group 11 does not emit light, the second pixel unit of the pixel group 11 instead uses the second sub-pixel 12 thereof to form a light-emitting bright spot, and the third pixel unit of the pixel group 11 instead uses the fourth sub-pixel 12 thereof to form a light-emitting bright spot. As shown in FIG. 6B, the sub-pixel R of the pixel unit P1 is darken, and the sub-pixel G of the pixel unit P4 is darken. At this time, the pixel units P1, P2, and P3 form two pixels, that is, the pixel unit P2 instead uses the sub-pixel G of the pixel unit P1 to form a pixel GBR, and the pixel unit P3 instead uses the sub-pixel R of the pixel unit P2 to form a pixel RGB. The pixel units P4, P5 and P6 form two pixels, that is, the pixel unit P5 instead uses the sub-pixel B of the pixel unit P4 to form a pixel BRG, and the pixel unit P6 instead uses the sub-pixel G of the pixel unit P5 to form a pixel GBR, and so on. Each of the pixel groups forms two pixels.

As shown in FIGS. 6A and 6B, the pixel unit in a pixel group achieves the normal display by instead using the neighboring sub-pixel, and the darkened sub-pixels of the odd-numbered and even-numbered frames are different, thereby preventing the darkened sub-pixel from being viewed by the human eye. The power consumption of the display panel provided in FIGS. 6A and 6B is low, and each of the sub-pixels 12 is not in a darkened state in both of two adjacent frames of pictures, so that defects such as black dots can be prevented from being observed by the human eye, thereby ensuring the display effect of the display panel.

Figure 7A:
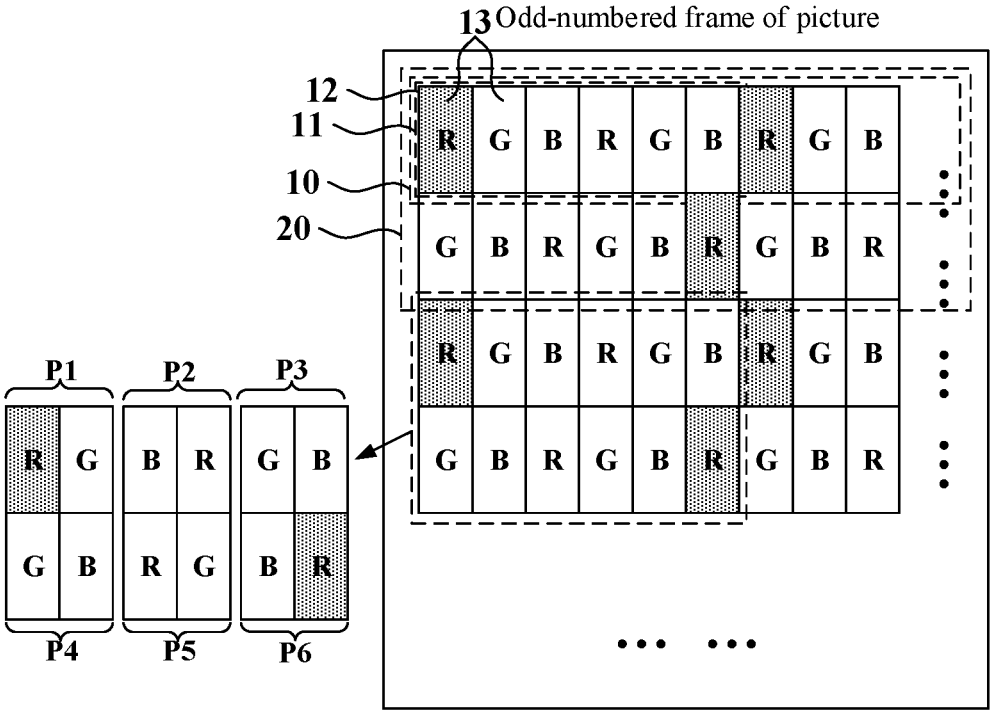
Figure 7B:
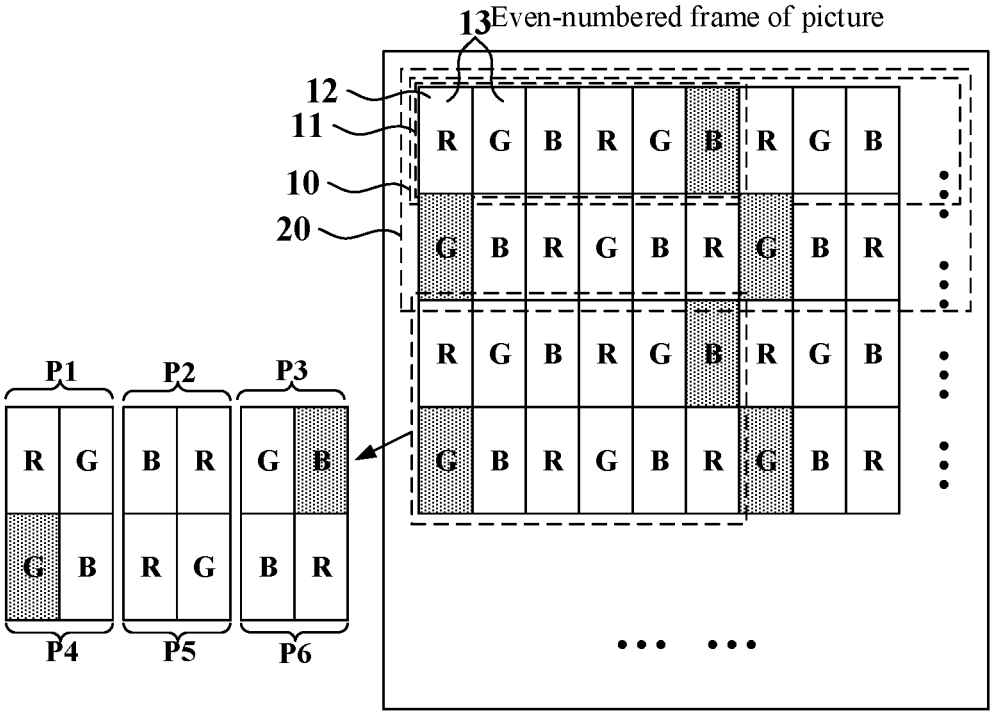

On the basis of the technical solution shown in FIG. 5, the second display mode may be provided as shown in FIGS. 7A and 7B. Specifically, in the odd-numbered frame of picture, the controller controls the q-th sub-pixel 12 of each of the pixel groups 11 in each of the first pixel rows 10 to not emit light, and the controller controls the p-th sub-pixel 12 of each of the pixel groups 11 in each of the second pixel rows 10 to not emit light. In the even-numbered frame of picture, the controller controls the p-th sub-pixel 12 of each of the pixel groups 11 in each of the first pixel rows 10 to not emit light, and the controller controls the q-th sub-pixel 12 of each of the pixel groups 11 in each of the second pixel rows 10 to not emit light, and q=1 and p=6, or q=6 and p=1. FIGS. 7A and 7B show only the case where q=1 and p=6. In other embodiments, it is also possible that q=6 and p=1.

In one embodiment, for each of the pixel groups 11, when the sixth sub-pixel of the pixel group 11 does not emit light, the first pixel unit of the pixel group 11 instead uses the third sub-pixel 12 thereof to form a light-emitting bright spot, and the second pixel unit of the pixel group 11 instead uses the fifth sub-pixel 12 thereof to form a light-emitting bright spot. In one embodiment, for each of the pixel groups 11, when the first sub-pixel 12 of the pixel group 11 does not emit light, the second pixel unit of the pixel group 11 instead uses the second sub-pixel 12 thereof to form a light-emitting bright spot, and the third pixel unit of the pixel group 11 instead uses the fourth sub-pixel 12 thereof to form a light-emitting bright spot.

As shown in FIG. 7A, when the controller controls odd-numbered fames of pictures, in the first pixel row, the sub-pixel R of the pixel unit P1 is darken. At this time, the pixel units P1, P2, and P3 form two pixels, that is, the pixel unit P2 instead uses the sub-pixel G of the pixel unit P1 to form a pixel GBR, and the pixel unit P3 instead uses the sub-pixel R of the pixel unit P2 to form a pixel RGB. In the second pixel row, the sub-pixel R of the pixel unit P4 is darken. At this time, the pixel units P4, P5 and P6 form two pixels, that is, the pixel unit P4 instead uses the sub-pixel R of the pixel unit P5 to form a pixel GBR, and the pixel unit P5 instead uses the sub-pixel B of the pixel unit P6 to form a pixel RGB, and so on. Each of the pixel groups forms two pixels.

As shown in FIG. 7B, when the controller controls even-numbered fames of pictures, in the first pixel row, the sub-pixel B of the pixel unit P3 is darken. At this time, the pixel units P1, P2, and P3 form two pixels, that is, the pixel unit P1 instead uses the sub-pixel B of the pixel unit P2 to form a pixel RGB, and the pixel unit P2 instead uses the sub-pixel G of the pixel unit P3 to form a pixel BRG In the second pixel row, the sub-pixel G of the pixel unit P4 is darken. At this time, the pixel units P4, P5 and P6 form two pixels, that is, the pixel unit P5 instead uses the sub-pixel B of the pixel unit P4 to form a pixel BRG, and the pixel unit P6 instead uses the sub-pixel G of the pixel unit P5 to form a pixel GBR, and so on. Each of the pixel groups forms two pixels.

As shown in FIGS. 7A and 7B, the pixel unit in a pixel group achieves the normal display by instead using the neighboring sub-pixel to form a pixel including R, G and B, and the darkened sub-pixels in the odd-numbered and even-numbered frames are different, thereby preventing the darkened sub-pixel from being viewed by the human eye. The power consumption of the display panel provided in FIGS. 7A and 7B is low and also defects such as black dots can be prevented from being observed by the human eye, thereby ensuring the display effect of the display panel.

Figure 8A:
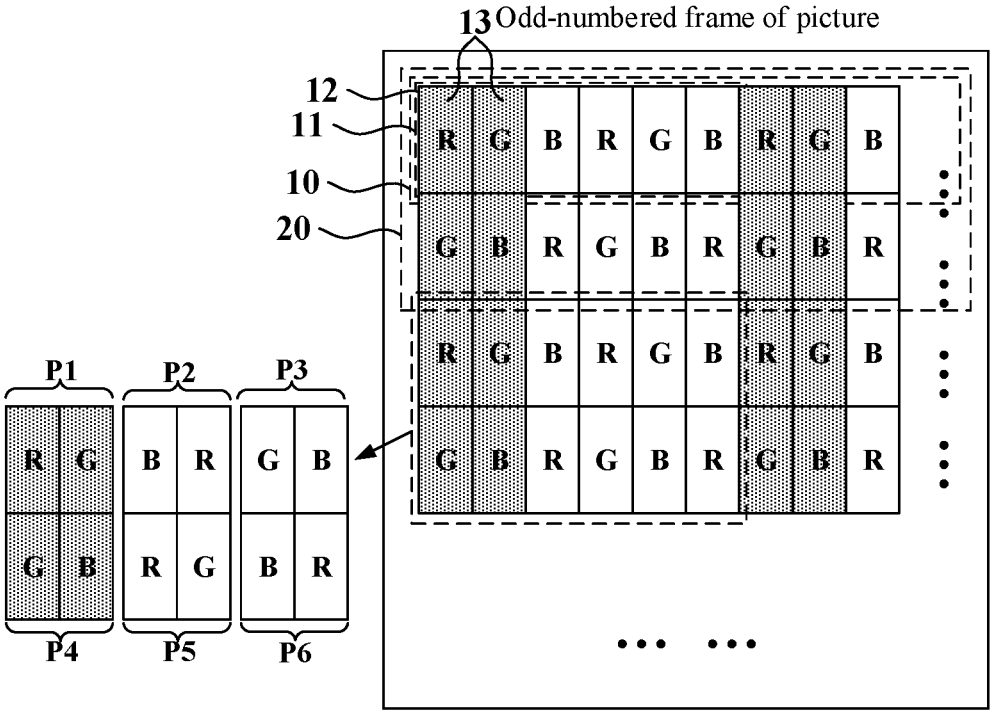
Figure 8B:
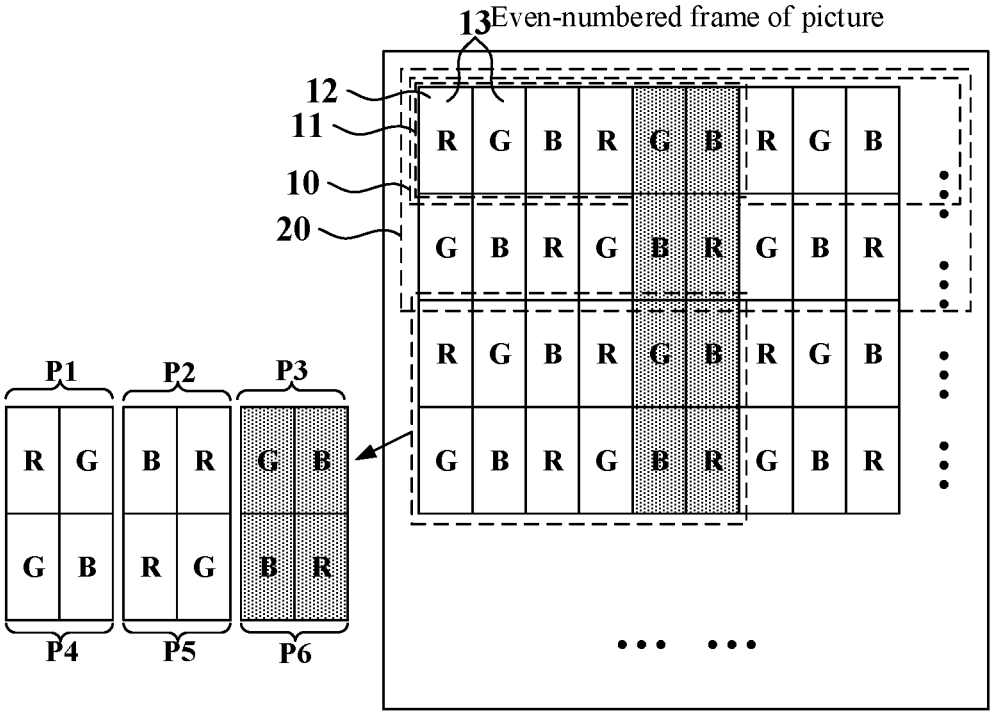

On the basis of the technical solution shown in FIG. 5, the second display mode may be provided as shown in FIGS. 8A and 8B. Specifically, in the odd-numbered frame of picture, the controller controls each of the sub-pixels 12 of the q-th pixel unit 13 of each of the pixel groups 11 to not emit light. In the even-numbered frame of picture, the controller controls each of the sub-pixels 12 of the p-th pixel unit 13 of each of the pixel groups 11 to not emit light, and q=1 and p=3, or q=3 and p=1. FIGS. 8A and 8B show only the case where q=1 and p=3. In other embodiments, it is also possible that q=3 and p=1.

In one embodiment, for each of the pixel groups 11, when the first pixel unit 13 of the pixel group 11 does not emit light, the second pixel unit 13 of the pixel group 11 instead uses the fifth sub-pixel 12 thereof to form a light-emitting bright spot, and the third pixel unit of the pixel group 11 instead uses the fourth sub-pixel 12 thereof to form a light-emitting bright spot. In one embodiment, for each of the pixel groups 11, when the third pixel unit 13 of the pixel group 11 does not emit light, the first pixel unit 13 of the pixel group 11 instead uses the third sub-pixel 12 thereof to form a light-emitting bright spot, and the second pixel unit 13 of the pixel group 11 instead uses the second sub-pixel 12 thereof to form a light-emitting bright spot.

As shown in FIG. 8A, when the controller controls odd-numbered fames of pictures, the controller controls each of the sub-pixels 12 of the first pixel unit 13 in each of the pixel group 11 to not emit light, for example, the pixel units P1 and P4 are darken. At this time, the pixel units P2 and P3 form two pixels, that is, the pixel unit P2 instead uses the sub-pixel G of the pixel unit P3 to form a pixel BRG, and the pixel unit P3 instead uses the sub-pixel R of the pixel unit P2 to form a pixel RGB. The pixel units P5 and P6 form two pixels, that is, the pixel unit P5 instead uses the sub-pixel B of the pixel unit P6 to form a pixel RGB, and the pixel unit P6 instead uses the sub-pixel G of the pixel unit P5 to form a pixel GBR, and so on. Each of the pixel groups forms two pixels.

As shown in FIG. 8B, when the controller controls odd-numbered fames of pictures, the controller controls each of the sub-pixels 12 of the third pixel unit 13 in each of the pixel group 11 to not emit light, for example, the pixel units P3 and P6 are darken. At this time, the pixel units P1 and P2 form two pixels, that is, the pixel unit P1 instead uses the sub-pixel B of the pixel unit P2 to form a pixel RGB, and the pixel unit P2 instead uses the sub-pixel G of the pixel unit P1 to form a pixel GBR. The pixel units P4 and P5 form two pixels, that is, the pixel unit P4 instead uses the sub-pixel R of the pixel unit P5 to form a pixel GBR, and the pixel unit P5 instead uses the sub-pixel B of the pixel unit P4 to form a pixel BRG, and so on. Each of the pixel groups forms two pixels.

As shown in FIGS. 8A and 8B, the pixel unit in a pixel group achieves the normal display by instead using the neighboring sub-pixel to form a pixel including R, G and B, and the darkened sub-pixels in the odd-numbered and even-numbered frames are different, thereby preventing the darkened sub-pixel from being viewed by the human eye. The power consumption of the display panel provided in FIGS. 7A and 7B is low and also defects such as black dots can be prevented from being observed by the human eye, thereby ensuring the display effect of the display panel.

Figure 9A:
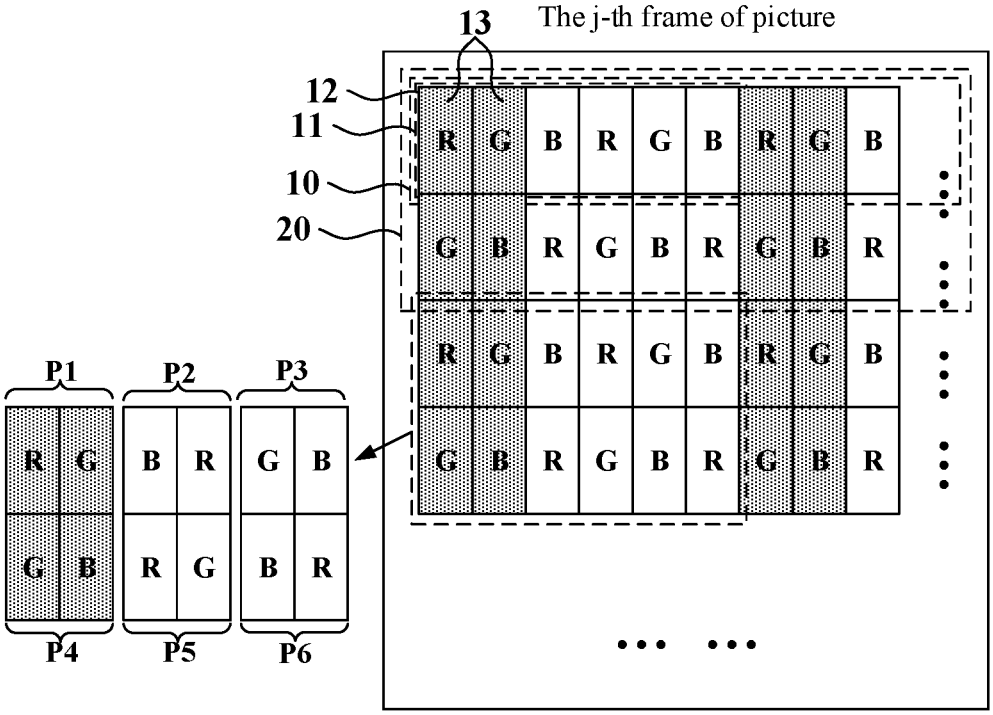
Figure 9B:
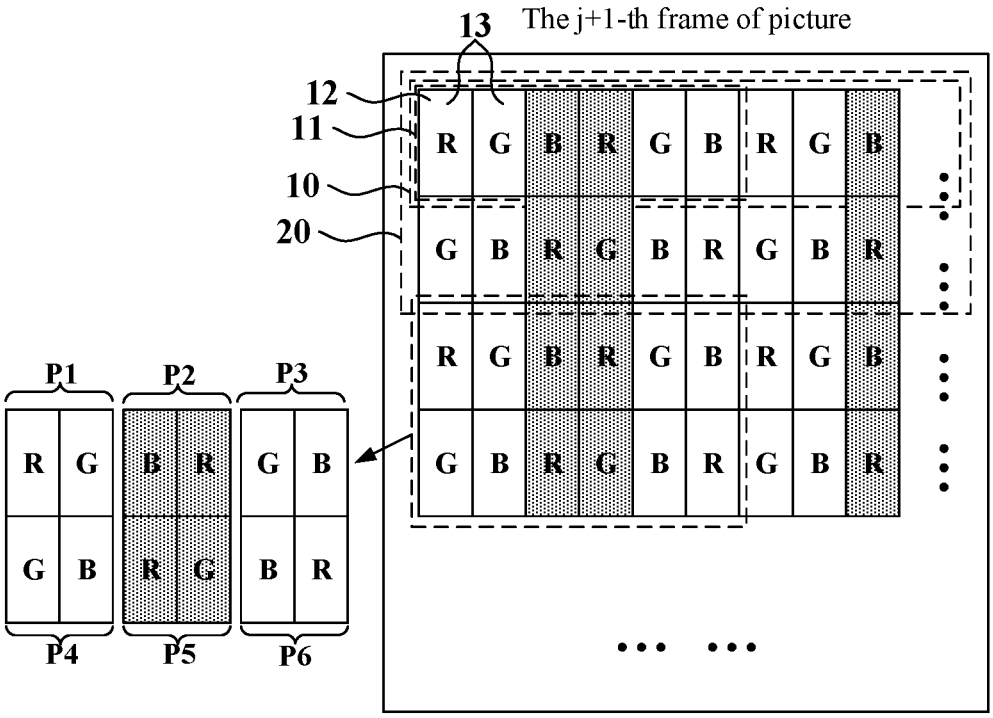
Figure 9C:
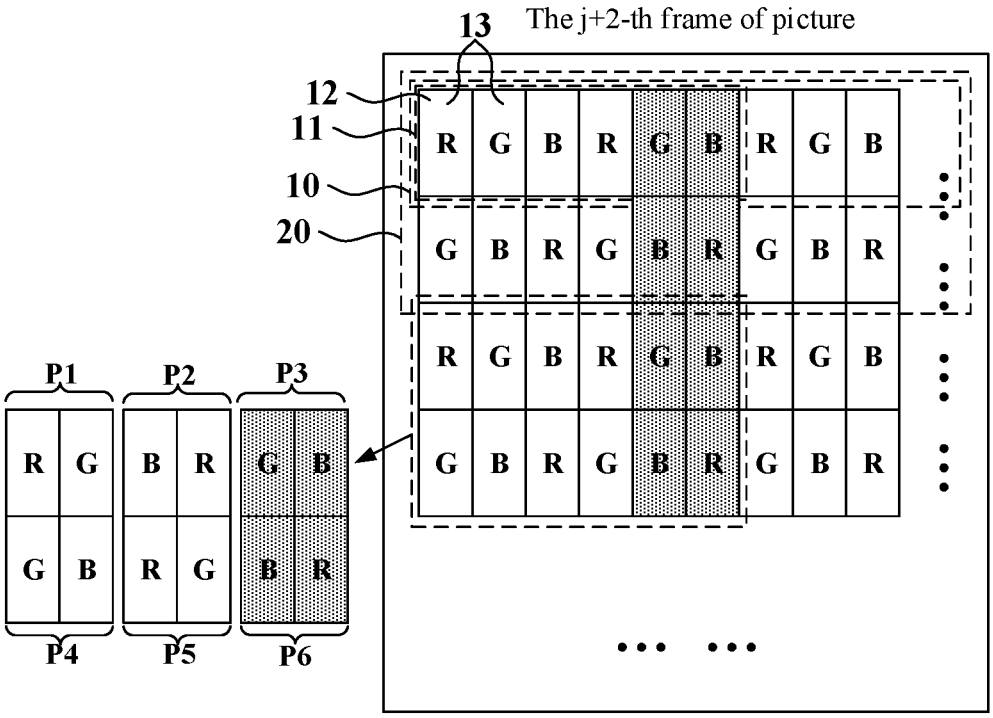

On the basis of the technical solution shown in FIG. 5, the second display mode may be provided as shown in FIGS. 9A to 9C. Specifically, in the j-th frame of picture, the controller controls each of the sub-pixels 12 of the first pixel unit 13 of each of the pixel groups 11 to not emit light. In the j+1-th frame of picture, the controller controls each of the sub-pixels 12 of the second pixel unit 13 of each of the pixel groups 11 to not emit light. In the j+2-th frame of picture, the controller controls each of the sub-pixels 12 of the third pixel unit 13 of each of the pixel groups 11 to not emit light.

In one embodiment, for each of the pixel groups 11, when the first pixel unit 13 of the pixel group 11 does not emit light, the second pixel unit 13 of the pixel group 11 instead uses a sub-pixel 12 which is located in a pixel unit in the row adjacent to and the column same with the second pixel unit 13 and has a different color from the sub-pixels of the second pixel unit 13 to form a light-emitting bright spot, and the third pixel unit 13 of the pixel group 11 instead uses a sub-pixel 12 which is located in a pixel unit in the row adjacent to and the column same with the third pixel unit 13 and has a different color from the sub-pixels of the third pixel unit 13 to form a light-emitting bright spot; for each of the pixel groups 11, when the second pixel unit 13 of the pixel group 11 does not emit light, the first pixel unit 13 of the pixel group 11 instead uses a sub-pixel 12 which is located in a pixel unit in the row adjacent to and the column same with the first pixel unit 13 and has a different color from the sub-pixels of the first pixel unit 13 to form a light-emitting bright spot, and the third pixel unit 13 of the pixel group 11 instead uses a sub-pixel 12 which is located in a pixel unit in the row adjacent to and the column same with the third pixel unit 13 and has a different color from the sub-pixels of the third pixel unit 13 to form a light-emitting bright spot; and for each of the pixel groups 11, when the third pixel unit 13 of the pixel group 11 does not emit light, the first pixel unit 13 of the pixel group 11 instead uses a sub-pixel 12 which is located in a pixel unit in the row adjacent to and the column same with the first pixel unit 13 and has a different color from the sub-pixels of the first pixel unit 13 to form a light-emitting bright spot, and the second pixel unit 13 of the pixel group 11 instead uses a sub-pixel 12 which is located in a pixel unit in the row adjacent to and the column same with the second pixel unit 13 and has a different color from the sub-pixels of the second pixel unit 13 to form a light-emitting bright spot.

As shown in FIG. 9A, when the controller controls the j-th fame of picture, the controller controls each of the sub-pixels 12 of the first pixel unit 13 in each of the pixel group 11 to not emit light, for example, the pixel units P1 and P4 are darken. At this time, the pixel units P2 and P3 form two pixels, that is, the pixel unit P2 instead uses the sub-pixel G of the pixel unit P5 to form a pixel BRG, and the pixel unit P3 instead uses the sub-pixel R of the pixel unit P6 to form a pixel GBR. The pixel units P5 and P6 form two pixels, that is, the pixel unit P5 instead uses the sub-pixel B of the pixel unit P2 to form a pixel RGB, and the pixel unit P6 instead uses the sub-pixel G of the pixel unit P3 to form a pixel BRG, and so on. Each of the pixel groups forms two pixels.

As shown in FIG. 9B, when the controller controls the j+1-th fame of picture, the controller controls each of the sub-pixels 12 of the second pixel unit 13 in each of the pixel group 11 to not emit light, for example, the pixel units P2 and P5 are darken. At this time, the pixel units P1 and P3 form two pixels, that is, the pixel unit P1 instead uses the sub-pixel B of the pixel unit P4 to form a pixel RGB, and the pixel unit P3 instead uses the sub-pixel R of the pixel unit P6 to form a pixel GBR. The pixel units P4 and P6 form two pixels, that is, the pixel unit P4 instead uses the sub-pixel R of the pixel unit P1 to form a pixel GBR, and the pixel unit P6 instead uses the sub-pixel G of the pixel unit P3 to form a pixel BRG, and so on. Each of the pixel groups forms two pixels.

As shown in FIG. 9C, when the controller controls the j+2-th fame of picture, the controller controls each of the sub-pixels 12 of the third pixel unit 13 in each of the pixel group 11 to not emit light, for example, the pixel units P3 and P6 are darken. At this time, the pixel units P1 and P2 form two pixels, that is, the pixel unit P1 instead uses the sub-pixel B of the pixel unit P4 to form a pixel RGB, and the pixel unit P2 instead uses the sub-pixel G of the pixel unit P5 to form a pixel BRG. The pixel units P4 and P5 form two pixels, that is, the pixel unit P4 instead uses the sub-pixel R of the pixel unit P1 to form a pixel GBR, and the pixel unit P5 instead uses the sub-pixel B of the pixel unit P2 to form a pixel RGB, and so on. Each of the pixel groups forms two pixels.

In the above example, the pixel unit in a pixel group achieves the normal display by instead using a sub-pixel which is located in a located in a pixel unit in the row adjacent to and the column same with the pixel unit to form a pixel including R, G and B, and the darkened sub-pixels of the successive three frames are different, thereby preventing the darkened sub-pixel from being viewed by the human eye based on a period of three frames. The power consumption of the display panel is low, and defects such as black dots can be prevented from being observed by the human eye, thereby ensuring the display effect of the display panel.

Figure 10A:
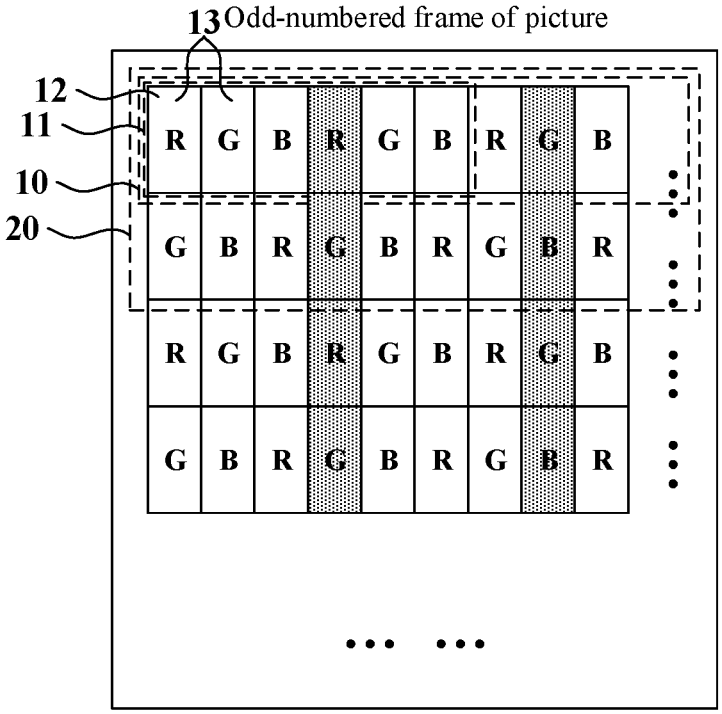
Figure 10B:
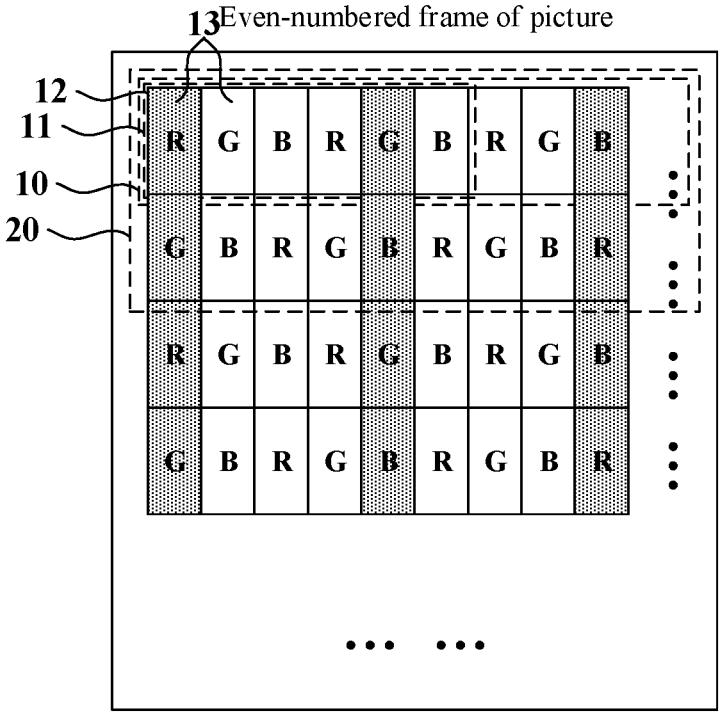

On the basis of the technical solution shown in FIG. 5, the second display mode may be provided as shown in FIGS. 10A and 10B. Specifically, in the odd-numbered frame of picture, the controller controls the 4h-th sub-pixel 12 of each of the pixel rows 10 to not emit light, and in the even-numbered frame of picture, the controller controls the 4h-3-th sub-pixel 12 of each of the pixel rows 10 to not emit light, and h=1, 2, 3, . . . . In one embodiment, the three sub-pixels between each two adjacent sub-pixels of the darken sub-pixels 12 of the pixel row 10 can be provided to form a light-emitting bright spot.

As shown in FIG. 10A, when the control panel displays odd-numbered frames of pictures, the fourth, eighth, twelfth, sixteenth, twentieth . . . sub-pixels 12 of each of the pixel rows 10 to not emit light. At this time, three sub-pixels between each two of darken adjacent sub-pixels 12 in the odd-numbered pixel rows 10 form one pixel, and the formed pixels are arranged in an order of RGB, GBR, BRG, RGB, . . . , and three sub-pixels between each two of darken adjacent sub-pixels 12 in the even-numbered pixel rows 10 form one pixel, and the formed pixels are arranged in an order of GBR, BRG, RGB, GBR, . . . .

As shown in FIG. 10B, when the control panel displays even-numbered frames of pictures, the first, fifth, ninth, thirteenth, seventeenth..... sub-pixels 12 of each of the pixel rows 10 to not emit light. At this time, three sub-pixels between each two of darken adjacent sub-pixels 12 in the odd-numbered pixel rows 10 form one pixel, and the formed pixels are arranged in an order of GBR, BRG, RGB, GBR, . . . , and three sub-pixels between each two of darken adjacent sub-pixels 12 in the even-numbered pixel rows 10 form one pixel, and the formed pixels are arranged in an order of BRG, RGB, GBR, BRG, . . . .

When the display panel shown in FIGS. 10A to 10B displays a picture by using the second display mode, each of the light emitting pixels is formed of three adjacent sub-pixels, and it is not necessary to instead use other sub-pixel. In the above example, the power consumption of the display panel is low, and the defects such as black spots can be prevented from being observed in the human eye, so that the display of the display panel can be ensured.

It will be understood by those skilled in the art that when the display panel uses the second display mode to display a picture, the order arrangement of the darken sub-pixels can be set under the premise of easy use of the sub-pixels and easy formation of the pixels, and is not limited to any of the above examples. It should be noted that when the display panel uses the second display mode to display a picture, if a certain sub-pixel is used instead, the driving process thereof is similar to that of the prior art and hence will not be described here.

Figure 11:
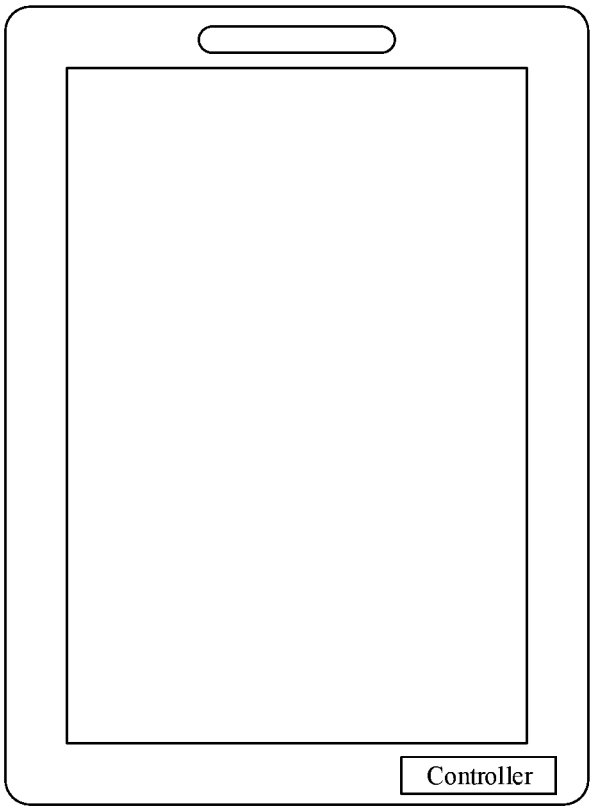
FIG. 11 is a schematic view of an electronic device according to an embodiment of the present disclosure.

FIG. 11 is a schematic diagram of an electronic device according to an embodiment of the present disclosure. As shown in FIG. 11, the electronic device provided by the present embodiment includes the display panel as described in any of the above embodiments. The optional electronic device is a smartphone. In one embodiment, when the power of the electronic device is greater than or equal to the predetermined power, the display panel of the electronic device displays pixels in the first display mode; and when the power of the electronic device is lower than the predetermined power, the display panel of the electronic device displays pixels in the second display mode. In one embodiment, the predominated power is 20% of the rated power of the electronic device.

The electronic device provided by the present embodiment integrates the display panel described in any of the above embodiments, and the display panel includes the first display mode and the second display mode. When the display panel uses the first display mode to display a picture, a high-quality and high-resolution displayed picture can be obtained. When the display panel uses the second display mode to display a picture, the power consumption can be reduced while ensuring a good display performance. Based on this, optionally a high quality displayed picture is obtained by using the first display mode when the electric power of the electronic device is sufficient; and when the electric power is insufficient, the number of the light-emitting pixels is reduced by using the second display mode i.e., SPR in which a picture with a low-resolution is displayed by the high-resolution screen to reduce the power consumption and hence extend the battery life of the electronic devices.

It should be noted that the embodiments of the present disclosure and the technical principles used therein are described as above. It should be appreciated that the disclosure is not limited to the particular embodiments described herein, and any apparent alterations, modification and substitutions can be made without departing from the scope of protection of the disclosure. Accordingly, while the disclosure is described in detail through the above embodiments, the disclosure is not limited to the above embodiments and can further include other additional embodiments without departing from the concept of the disclosure.

What is claimed is:

1. A display panel, comprising:

a plurality of sub-pixels arranged in an array, wherein each pixel row of the sub-pixels comprises 3n sub-pixels, with every six adjacent sub-pixels of the pixel row forming a pixel group, wherein n≥2, and wherein the six adjacent sub-pixels of the pixel group are arranged in sequential order in a first direction, and the first direction is parallel to the row direction; and a controller; wherein the controller controls, in a first display mode, each of the sub-pixels to be charged to emit light; and the controller controls, in a second display mode, at most two sub-pixels of each of the pixel groups in at least one of the pixel rows to not emit light, and the controller controls, in the second display mode, at most two sub-pixels of the pixel group which have same order in two adjacent frames of pictures to not emit light;

wherein in the second display mode, the controller controls two sub-pixels of each of the pixel groups in the odd-numbered pixel rows to not emit light, and the controller controls two sub-pixels of each of the pixel groups in the even-numbered pixel rows to not emit light, wherein for a frame of picture, the two sub-pixels of a pixel group in a column which do not emit light have different orders from the two sub-pixels of the adjacent pixel group in the column which do not emit light; and for two adjacent frames of pictures, the two sub-pixels of a pixel group in the frame which do not emit light have different orders from the two sub-pixels of the pixel group in the next frame which do not emit light.

2. The display panel as claimed in claim 1, wherein the sub-pixels of each of the pixel groups in each pixel row are arranged in the order of colors R, G, B, R, G and B.

3. The display panel as claimed in claim 1, wherein the plurality of sub-pixels form a plurality of sub-pixel regions arranged in a sequential order in a column direction, each of the pixel regions comprises a first pixel row to an m-th pixel row, wherein m≤2;

in each of the pixel regions, a pixel unit is formed by every two adjacent sub-pixels in the i-th pixel row, a pixel group is formed by every three pixel unit, the pixel groups are arranged in the i-th color order, and two adjacent sub-pixels have different colors, respectively, wherein i=1,2, ..., m.

4. The display panel as claimed in claim 3, wherein the length of each of the sub-pixels in the column direction is two times the length of the sub-pixel in the row direction.

5. The display panel as claimed in claim 4, wherein the two sub-pixels of each of the pixel units form a square pixel zone.

6. The display panel as claimed in claim 3, wherein m≤3, and the pixel groups of the first pixel row are arranged in the first color order of R, G, B, R, G and B, and the pixel groups of the second pixel row are arranged in the second color order of G, B, R, G, B and R.

7. The display panel as claimed in claim 6, wherein the pixel groups of the third pixel row are arranged in the third color order of B, R, G, B, R and G.

8. An electronic device, comprising a display panel of claim 1.

9. The electronic device as claimed in claim 8, wherein when the electric power of the electronic device is greater than or equal to a predetermined electric power, the display panel of the electronic device displays pixels in the first display mode; and when the electric power of the electronic device is lower than the predetermined electric power, the display panel of the electronic device displays pixels in the second display mode.

10. A display panel, comprising:

a plurality of sub-pixels arranged in an array, wherein each pixel row of the sub-pixels comprises 3n sub-pixels, with every six adjacent sub-pixels of the pixel row forming a pixel group, wherein n≥2, and wherein the six adjacent sub-pixels of the pixel group are arranged in sequential order in a first direction, and the first direction is parallel to the row direction; and a controller; wherein the controller controls, in a first display mode, each of the sub-pixels to be charged to emit light; and the controller controls, in a second display mode, at most two sub-pixels of each of the pixel groups in at least one of the pixel rows to not emit light, and the controller controls, in the second display mode, at most two sub-pixels of the pixel group which have same order in two adjacent frames of pictures to not emit light, wherein in the second display mode, in the i-th frame of picture, the controller controls two sub-pixels of each of the pixel groups in the odd-numbered pixel rows to not emit light and controls each of the sub-pixels in the even-numbered pixel rows to emit light, and in the i+1-th frame of picture, the controller controls two sub-pixels of each of the pixel groups in the even-numbered pixel rows to not emit light and controls each of the sub-pixels in the odd-numbered pixel rows to emit light;

wherein i is an integer greater than or equal to 1.

11. The display panel as claimed in claim 10, wherein the two sub-pixels of each of the pixel groups in the odd-numbered pixel rows which do not emit light have same orders from the two sub-pixels of each of the pixel groups in the even-numbered pixel rows which do not emit light.

12. A display panel, comprising:

a plurality of sub-pixels arranged in an array, wherein each pixel row of the sub-pixels comprises 3n sub-pixels, with every six adjacent sub-pixels of the pixel row forming a pixel group, wherein n≥2, and wherein the six adjacent sub-pixels of the pixel group are arranged in sequential order in a first direction, and the first direction is parallel to the row direction; and a controller; wherein the controller controls, in a first display mode, each of the sub-pixels to be charged to emit light; and the controller controls, in a second display mode, at most two sub-pixels of each of the pixel groups in at least one of the pixel rows to not emit light, and the controller controls, in the second display mode, at most two sub-pixels of the pixel group which have same order in two adjacent frames of pictures to not emit light;

wherein the plurality of sub-pixels form a plurality of sub-pixel regions arranged in a sequential order in a column direction, each of the pixel regions comprises a first pixel row to an m-th pixel row, wherein m≥2; in each of the pixel regions, a pixel unit is formed by every two adjacent sub-pixels in the i-th pixel row, a pixel group is formed by every three pixel unit, the pixel groups are arranged in the i-th color order, and two adjacent sub-pixels have different colors, respectively, wherein i=1,2, . . . , m;

wherein in the second display mode, in the odd-numbered frames of pictures, the controller controls the q-th sub-pixel of each of the pixel groups to not emit light, and in the even-numbered frames of pictures, the controller controls the p-th sub-pixel of each of the pixel groups to not emit light, wherein one of q and p is equal to 1, and the other of q and p is equal to 6.

13. The display panel as claimed in claim 12, wherein for each of the pixel groups, when the first sub-pixel of the pixel group does not emit light, the second pixel unit of the pixel group instead uses the second sub-pixel of the pixel group to form a light-emitting bright spot, and the third pixel unit of the pixel group instead uses the fourth sub-pixel of the pixel group to form a light-emitting bright spot; and for each of the pixel groups, when the sixth sub-pixel of the pixel group does not emit light, the first pixel unit of the pixel group instead uses the third sub-pixel of the pixel group to form a light-emitting bright spot, and the second pixel unit of the pixel group instead uses the fifth sub-pixel of the pixel group to form a light-emitting bright spot.

14. A display panel, comprising:

a plurality of sub-pixels arranged in an array, wherein each pixel row of the sub-pixels comprises 3n sub-pixels, with every six adjacent sub-pixels of the pixel row forming a pixel group, wherein n≥2, and wherein the six adjacent sub-pixels of the pixel group are arranged in sequential order in a first direction, and the first direction is parallel to the row direction; and a controller; wherein the controller controls, in a first display mode, each of the sub-pixels to be charged to emit light; and the controller controls, in a second display mode, at most two sub-pixels of each of the pixel groups in at least one of the pixel rows to not emit light, and the controller controls, in the second display mode, at most two sub-pixels of the pixel group which have same order in two adjacent frames of pictures to not emit light;

wherein the plurality of sub-pixels form a plurality of sub-pixel regions arranged in a sequential order in a column direction, each of the pixel regions comprises a first pixel row to an m-th pixel row, wherein m≥2; in each of the pixel regions, a pixel unit is formed by every two adjacent sub-pixels in the i-th pixel row, a pixel group is formed by every three pixel unit, the pixel groups are arranged in the i-th color order, and two adjacent sub-pixels have different colors, respectively, wherein i=1,2, . . . , m;

wherein in the second display mode, in the odd-numbered frames of pictures, the controller controls the q-th sub-pixel of each of the pixel groups in each of the first pixel rows to not emit light, and the controller controls the p-th sub-pixel of each of the pixel groups in each of the second pixel rows to not emit light, and in the even-numbered frames of pictures, the controller controls the p-th sub-pixel of each of the pixel groups in each of the first pixel rows to not emit light, and the controller controls the q-th sub-pixel of each of the pixel groups in each of the second pixel rows to not emit light, wherein one of q and p is equal to 1, and the other of q and p is equal to 6.

15. A display panel, comprising:

a plurality of sub-pixels arranged in an array, wherein each pixel row of the sub-pixels comprises 3n sub-pixels, with every six adjacent sub-pixels of the pixel row forming a pixel group, wherein n≥2, and wherein the six adjacent sub-pixels of the pixel group are arranged in sequential order in a first direction, and the first direction is parallel to the row direction; and a controller; wherein the controller controls, in a first display mode, each of the sub-pixels to be charged to emit light; and the controller controls, in a second display mode, at most two sub-pixels of each of the pixel groups in at least one of the pixel rows to not emit light, and the controller controls, in the second display mode, at most two sub-pixels of the pixel group which have same order in two adjacent frames of pictures to not emit light;

wherein the plurality of sub-pixels form a plurality of sub-pixel regions arranged in a sequential order in a column direction, each of the pixel regions comprises a first pixel row to an m-th pixel row, wherein m≥2; in each of the pixel regions, a pixel unit is formed by every two adjacent sub-pixels in the i-th pixel row, a pixel group is formed by every three pixel unit, the pixel groups are arranged in the i-th color order, and two adjacent sub-pixels have different colors, respectively, wherein i=1,2, . . . , m;

wherein in the second display mode, in the odd-numbered frames of pictures, the controller controls each of the sub-pixels in the q-th pixel unit of each of the pixel groups to not emit light, and in the even-numbered frames of pictures, the controller controls each of the sub-pixels in the p-th pixel unit of each of the pixel groups to not emit light, wherein one of q and p is equal to 1, and the other of q and p is equal to 3.

16. The display panel as claimed in claim 15, wherein for each of the pixel groups, when the first pixel unit of the pixel group does not emit light, the second pixel unit of the pixel group instead uses the fifth sub-pixel of the pixel group to form a light-emitting bright spot, and the third pixel unit of the pixel group instead uses the fourth sub-pixel of the pixel group to form a light-emitting bright spot; and for each of the pixel groups, when the third pixel unit of the pixel group does not emit light, the first pixel unit of the pixel group instead uses the third sub-pixel of the pixel group to form a light-emitting bright spot, and the second pixel unit of the pixel group instead uses the second sub-pixel of the pixel group to form a light-emitting bright spot.

17. A display panel, comprising:

a plurality of sub-pixels arranged in an array, wherein each pixel row of the sub-pixels comprises 3n sub-pixels, with every six adjacent sub-pixels of the pixel row forming a pixel group, wherein n≥2, and wherein the six adjacent sub-pixels of the pixel group are arranged in sequential order in a first direction, and the first direction is parallel to the row direction; and a controller; wherein the controller controls, in a first display mode, each of the sub-pixels to be charged to emit light; and the controller controls, in a second display mode, at most two sub-pixels of each of the pixel groups in at least one of the pixel rows to not emit light, and the controller controls, in the second display mode, at most two sub-pixels of the pixel group which have same order in two adjacent frames of pictures to not emit light;

wherein the plurality of sub-pixels form a plurality of sub-pixel regions arranged in a sequential order in a column direction, each of the pixel regions comprises a first pixel row to an m-th pixel row, wherein m≥2; in each of the pixel regions, a pixel unit is formed by every two adjacent sub-pixels in the i-th pixel row, a pixel group is formed by every three pixel unit, the pixel groups are arranged in the i-th color order, and two adjacent sub-pixels have different colors, respectively, wherein i=1,2, . . . , m;

wherein in the second display mode, in the j-th frame of picture, the controller controls each of the sub-pixels of the first pixel unit of each of the pixel groups to not emit light, in the j+1-th frame of picture, the controller controls each of the sub-pixels of the second pixel unit of each of the pixel groups to not emit light, and in the j+2-th frame of picture, the controller controls each of the sub-pixels of the third pixel unit 13 of each of the pixel groups 11 to not emit light;

wherein j is an integer greater than or equal to 1.

18. The display panel as claimed in claim 17, wherein for each of the pixel groups, when the first pixel unit of the pixel group does not emit light, the second pixel unit of the pixel group instead uses a sub-pixel which is located in a pixel unit in the row adjacent to and the column same with the second pixel unit and has a different color from the sub-pixels of the second pixel unit to form a light-emitting bright spot, and the third pixel unit of the pixel group instead uses a sub-pixel which is located in a pixel unit in the row adjacent to and the column same with the third pixel unit and has a different color from the sub-pixels of the third pixel unit to form a light-emitting bright spot;

for each of the pixel groups, when the second pixel unit of the pixel group does not emit light, the first pixel unit of the pixel group instead uses a sub-pixel which is located in a pixel unit in the row adjacent to and the column same with the first pixel unit and has a different color from the sub-pixels of the first pixel unit to form a light-emitting bright spot, and the third pixel unit of the pixel group instead uses a sub-pixel which is located in a pixel unit in the row adjacent to and the column same with the third pixel unit and has a different color from the sub-pixels of the third pixel unit to form a light-emitting bright spot; and for each of the pixel groups, when the third pixel unit of the pixel group does not emit light, the first pixel unit of the pixel group instead uses a sub-pixel which is located in a pixel unit in the row adjacent to and the column same with the first pixel unit and has a different color from the sub-pixels of the first pixel unit to form a light-emitting bright spot, and the second pixel unit of the pixel group instead uses a sub-pixel which is located in a pixel unit in the row adjacent to and the column same with the second pixel unit and has a different color from the sub-pixels of the second pixel unit to form a light-emitting bright spot.

19. A display panel, comprising:

a plurality of sub-pixels arranged in an array, wherein each pixel row of the sub-pixels comprises 3n sub-pixels, with every six adjacent sub-pixels of the pixel row forming a pixel group, wherein n≥2, and wherein the six adjacent sub-pixels of the pixel group are arranged in sequential order in a first direction, and the first direction is parallel to the row direction; and a controller; wherein the controller controls, in a first display mode, each of the sub-pixels to be charged to emit light; and the controller controls, in a second display mode, at most two sub-pixels of each of the pixel groups in at least one of the pixel rows to not emit light, and the controller controls, in the second display mode, at most two sub-pixels of the pixel group which have same order in two adjacent frames of pictures to not emit light;

wherein the plurality of sub-pixels form a plurality of sub-pixel regions arranged in a sequential order in a column direction, each of the pixel regions comprises a first pixel row to an m-th pixel row, wherein m≥2; in each of the pixel regions, a pixel unit is formed by every two adjacent sub-pixels in the i-th pixel row, a pixel group is formed by every three pixel unit, the pixel groups are arranged in the i-th color order, and two adjacent sub-pixels have different colors, respectively, wherein i=1,2, . . . , m;

wherein in the second display mode, in the odd-numbered frames of pictures, the controller controls the 4-th sub-pixel, 8-th sub-pixel, 12-th sub-pixel, 16-th sub-pixel . . . of each of the pixel rows to not emit light, and in the even-numbered frames of pictures, the controller controls the first sub-pixel, 5-th sub-pixel, 9-th sub-pixel, 13-th sub-pixel . . . of each of the pixel rows to not emit light.

20. The display panel as claimed in claim 19, wherein the three sub-pixels between each two adjacent sub-pixels of the sub-pixels of the pixel row which do not emit light form a light-emitting bright spot.

* * * * *